US005828170A

United States Patent [19]

Nishio et al.

[11] Patent Number: 5,828,170

[45] Date of Patent: Oct. 27, 1998

[54] FLUORESCENT LAMP UNIT AND LIGHTING APPARATUS HAVING THE FLUORESCENT LAMP UNIT

[75] Inventors: Kiyoshi Nishio; Kazuhisa Ogishi, both of Yokosuka; Takeo Yasuda; Toshiya Tanaka, both of Yokohama, all of Japan

[73] Assignee: Toshiba Lighting & Technology Corporation, Tokyo, Japan

[21] Appl. No.: 716,126

[22] Filed: Sep. 20, 1996

[30] Foreign Application Priority Data

| | | | |
|---|---|---|---|
| Sep. 29, 1995 | [JP] | Japan | 7-254337 |
| Sep. 29, 1995 | [JP] | Japan | 7-254338 |
| Oct. 31, 1995 | [JP] | Japan | 7-283517 |
| Dec. 25, 1995 | [JP] | Japan | 7-351644 |

[51] Int. Cl.[6] ..... H01J 61/32

[52] U.S. Cl. ..... 313/493; 313/493; 313/317; 362/362

[58] Field of Search ..... 313/493, 577, 313/580, 610, 634, 317; 362/362, 310

[56] References Cited

U.S. PATENT DOCUMENTS

| | | | |
|---|---|---|---|
| 4,871,944 | 10/1989 | Skwirut et al. | 313/493 X |
| 5,243,256 | 9/1993 | Holzer | 313/634 X |
| 5,610,476 | 3/1997 | Oga et al. | 313/493 X |

FOREIGN PATENT DOCUMENTS

| | | | |
|---|---|---|---|
| 62-58561 | 3/1987 | Japan | 313/493 |

*Primary Examiner*—Ashok Patel
*Attorney, Agent, or Firm*—Oblon, Spivak, McClelland, Maier & Neustadt, P.C.

[57] ABSTRACT

A fluorescent lamp unit includes a fluorescent lamp having a bulb constituting one discharge path, said bulb including three U-shaped tube portions, a lighting circuit operatively connected to the fluorescent lamp for lighting the fluorescent lamp, and a cover part having a cap at one end thereof and having a globe at other end thereof for containing the lighting circuit and the fluorescent lamp. Each of the three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions. The straight tube portions are arranged equidistantly on a circumference of a certain radius from the basic center axis. The three U-shaped tube portions are formed so that minimum gaps c1, c2*a*, and c2*b* between the inner surface of the globe and each of the outer surfaces of the globe side ends of the three U-shaped tubes have substantially a same length.

19 Claims, 13 Drawing Sheets

FLUORESCENT LAMP UNIT AND LIGHTING APPARATUS HAVING THE FLUORESCENT LAMP UNIT

BACKGROUND OF THE INVENTION

1. Field of the Invention

The present invention relates to a fluorescent lamp unit that has plural bent portions and to a lighting apparatus using the fluorescent lamp unit.

2. Description of the Related Art

In conventional fluorescent lamp units, there is a low pressure mercury gas type fluorescent lamp unit using a fluorescent lamp. The fluorescent lamp has one bent discharge path (one bent discharge bulb) which is formed by bending a bulb like a saddle-shape or a U-shape.

An example of such a low pressure mercury gas type fluorescent lamp unit has been described in Japanese Unexamined Patent Publication No. 62-58561. This fluorescent lamp unit includes a cover having a cap at one end. A lighting circuit is contained in the cover. A bent fluorescent lamp is attached to the other end of the cover through a partition. In particular, there is a fluorescent lamp unit having a fluorescent lamp covered with a globe in an effort to improve light diffusibility is also known.

The fluorescent lamp used for the lamp unit has the one bent discharge bulb. The one bent discharge bulb includes three U-shaped tubes each having a pair of straight tube portions provided straight in a direction parallel to a basic center axis of the lamp unit (along the center axis of the cap or the center axis of the globe), and also having a bent portion that is bent substantially like a U-shape with a predetermined point (for example, a substantially center point of the whole fluorescent lamp unit) on the basic center axis leading to the cap as a center of curvature and that links the ends of the pair of straight tube portions (lower ends) opposite to a cap. The U-shaped tubes are juxtaposed equidistantly in a direction crossed at substantially right angle to the basic center axis, while the straight tube portions are arranged equidistantly on a circumference of a certain radius from the basic center axis. The fluorescent lamp unit having the globe is formed by placing the bulb bent as mentioned above so that the bulb is in contact with the inner surface of the globe.

In short, according to the known fluorescent lamp, the bulb is bent in order to extend the length of a discharge path and to eventually increase a light output.

However, according to the known fluorescent lamp unit having the globe, the bulb constituting the fluorescent lamp is arranged so that the bulb is in contact with the inner surface of the globe. Therefore, even if the globe has light diffusibility, when the fluorescent lamp is lit, the shadow of the bulb is projected on the globe. This results in irregular luminance and is not preferable in terms of appearance. It is therefore conceived that the spacing between the bulb and the globe is made larger in order to minimize the shadow to be projected on the outer side of the globe. However, the bulb having three U-shaped juxtaposed tubes has larger dimensions than a bulb having two U-shaped tubes juxtaposed. If the dimensions of the globe are simply made larger, the lamp unit gets larger.

In an effort to make the bulb itself smaller, it is thought to reduce the spacing between adjoining straight tube portions of each U-shaped tube. When the spacing between the adjoining straight tube portions is made too small, part of light emanating from one of the adjoining straight tube portions falls on the other straight tube portion and is then absorbed thereby. This causes a problem of a large light loss and deteriorated light output efficiency. By contrast, if the spacing between the adjoining straight tube portions of each U-shaped tube is made larger, the fluorescent lamp itself and eventually the whole lamp unit get larger in dimensions. This causes a problem that the application of the lamp unit to lighting apparatuses in limited, each of the lighting apparatuses being designed for an incandescent lamp.

SUMMARY OF THE INVENTION

The present invention attempts to solve the foregoing problems.

An object of the present invention is to provide a fluorescent lamp unit having a bulb that is bent to include three U-shaped tubes, in which the irregular luminance on a globe is minimized without an increase in size of the unit itself or the glowing efficiency is improved, and a lighting apparatus having the fluorescent lamp unit.

Another object of the present invention is to provide a fluorescent lamp unit having a bulb that is bent to include three U-shaped tubes, wherein the size of the lamp unit is suitable to a lighting apparatuses each of which is designed for an incandescent lamp.

In order to achieve the such objects, according to one aspect of the present invention, there is provided a fluorescent lamp unit comprising a fluorescent lamp having a bulb constituting one discharge path, said bulb including three U-shaped tube portions, a lighting circuit operatively connected to the fluorescent lamp for lighting the fluorescent lamp, and a cover part having a cap at one end thereof and having a globe at other end thereof for containing the lighting circuit and the fluorescent lamp, wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis, and wherein said three U-shaped tube portions are formed so that minimum gaps c1, c2*a*, and c2*b* between the inner surface of the globe and each of the outer surfaces of the globe side ends of the three U-shaped tube portions have substantially a same length.

In preferred embodiment of this aspect, the three U-shaped tube portions are juxtaposed equidistantly in a direction crossed at substantially right angles to the basic center axis.

This aspect of the present invention has an arrangement that the globe is formed in substantially a spherical shape and said bent portion of the central U-shaped tube portion among the three U-shaped tube portions is made longer than the other bent portions of the U-shaped tube portions located at the both sides of the central U-shaped tube portion so that the bent portion of the central U-shaped tube portion projects toward the globe side along the basic center axis.

In order to achieve the such objects, according to another aspect of the present invention, there is provided a fluorescent lamp unit comprising a fluorescent lamp having a bulb constituting one discharge path, said bulb including three U-shaped tube portions, a lighting circuit operatively connected to the fluorescent lamp for lighting the fluorescent lamp, and a cover part having a cap at one end thereof and having a globe at other end thereof for containing the lighting circuit and the fluorescent lamp, wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis, and wherein said three U-shaped tube portions are formed so that the relationship between a diameter "b" of a circumscribed circle of the straight tube portions having the basic center axis as a center and a length "a" which is a maximum length along to the direction of the basic center axis of the bulb glowing effectively satisfy the following condition: $0.7<b/a<1.4$ In preferred embodiment of this another aspect, the three U-shaped tube portions are juxtaposed equidistantly in a direction crossed at substantially right angles to the basic center axis and wherein said globe is formed substantially in a spherical shape.

In order to achieve the such objects, according to another aspect of the present invention, there is provided a fluorescent lamp unit comprising a fluorescent lamp having a bulb constituting one discharge path, said bulb including three U-shaped tube portions a lighting circuit operatively connected to the fluorescent lamp for lighting the fluorescent lamp and a cover part having a cap at one end thereof for containing the lighting circuit, wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis, and wherein each of said three U-shaped tube portions are formed so that the relationship between a diameter "d" of the pair of straight tube portions constituting the U-shaped tube portion and a spacing "L" between the pair of straight tube portions satisfy the following condition:

$$0.5 \leqq d/L \leqq 1.5$$

In preferred embodiment of this another aspect, the cover part has a globe mounted to other end thereof for containing the fluorescent lamp.

These aspects of the present invention has an arrangement that the globe is made of a light-transmissible material.

These aspects of the present invention has an arrangement that the cover part has a length along to the basic center axis, said length being 140 mm or smaller and has a maximum diameter thereof, said maximum diameter being 100 mm or smaller.

In order to achieve the such objects, according to another aspect of the present invention, there is provided a lighting apparatus comprising a fluorescent lamp unit and an apparatus body to which the fluorescent lamp unit is mounted, the fluorescent lamp unit comprising, a fluorescent lamp having a bulb constituting one discharge path, said bulb including three U-shaped tube portions, a lighting circuit operatively connected to the fluorescent lamp for lighting the fluorescent lamp, and a cover part having a cap at one end thereof and having a globe at other end thereof for containing the lighting circuit and the fluorescent lamp, wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis, and wherein said three U-shaped tube portions are formed so that minimum gaps c1, c2*a*, and c2*b* between the inner surface of the globe and each of the outer surfaces of the globe side ends of the three U-shaped tube potions have substantially a same length.

In the fluorescent lamp unit and the lighting apparatus described above, since, the minimum gaps c1, c2*a*, and c2*b* between the inner surface of the globe and each of the outer surfaces of the globe side ends of the three U-shaped tubes have substantially a same length because, for example, the bent portion of the central U-shaped tube portion projects toward the globe side along the basic center axis, the shadow of the bulb itself of the fluorescent lamp projecting on the surface of the globe can be minimized, and eventually the luminance on the surface of the substantially spherical globe can be homogenized.

Moreover, in the fluorescent lamp unit and the lighting apparatus described above, the relationship between a diameter "b" of a circumscribed circle of the straight tube portions having the basic center axis as a center and a length "a" which is a maximum length along to the direction of the basic center axis of the bulb glowing effectively satisfy the following condition: $0.7<b/a<1.4$.

Therefore, a decrease in height a relative to the maximum diameter "b" of the effective glowing section occurring when the b/a value is equal to or larger than 1.4, an ensuing drop in luminance at the apex of the globe relative to the luminance on the lateral side thereof, and an ensuing increase in inhomogeneity of luminance on the globe can be prevented. Moreover, an increase in height a relative to the maximum diameter "b" of the effective glowing section occurring when the b/a value is equal to or smaller than 0.7, an ensuing drop in luminance on the lateral side of the substantially spherical globe relative to the luminance at the apex thereof, and an ensuing increase in inhomogeneity of luminance on the globe can be prevented. As a result of that, the homogeneity of luminance on the globe can be improved.

In addition, in the fluorescent lamp unit and the lighting fixture described above, the relationship between a diameter "d" of the pair of straight tube portions constituting the U-shaped tube portion and a spacing "L" between the pair of straight tube portions satisfy the following condition: $0.5 \leqq d/L \leqq 1.5$.

Consequently, it can be prevented an increase in light loss, which occurs in the case where the d/L value exceeds 1.5 whereby the spacing "L" between straight tube portions is too small relative to the diameter "d". Besides, it can be prevented an unnecessary increase in maximum diameter of the fluorescent lamp unit and an ensuing increase in inhomogeneity of light distribution, which occur when the d/L value falls below 0.5 or is less than 0.5 whereby the spacing "L" between straight tube portions is too large relative to the diameter "d". In other words, the loss in light emanating from the straight tube portions can be minimized optimally, while a compact design and homogeneous light distribution can be attained optimally. Moreover, since the fluorescent lamp unit is covered by the substantially spherical globe, the luminance on the surface of the globe can be homogenized.

Furthermore, the length (height) in the center axial direction of the fluorescent lamp unit including the length of the cap is equal to or smaller than 140 mm, and the maximum diameter thereof is equal to or smaller than 100 mm Accordingly, the fluorescent lamp unit conforms to the general dimensions for an electric lamp. The number of types of lighting apparatuses which are designed for an incandescent lamp and to which the fluorescent lamp unit can be fitted increases, expanding eventually the application range of the fluorescent lamp.

BRIEF DESCRIPTION OF THE DRAWINGS

Other objects and aspects of the invention will become apparent from the following description of embodiments with reference to the accompanying drawings in which.

Figure 1:
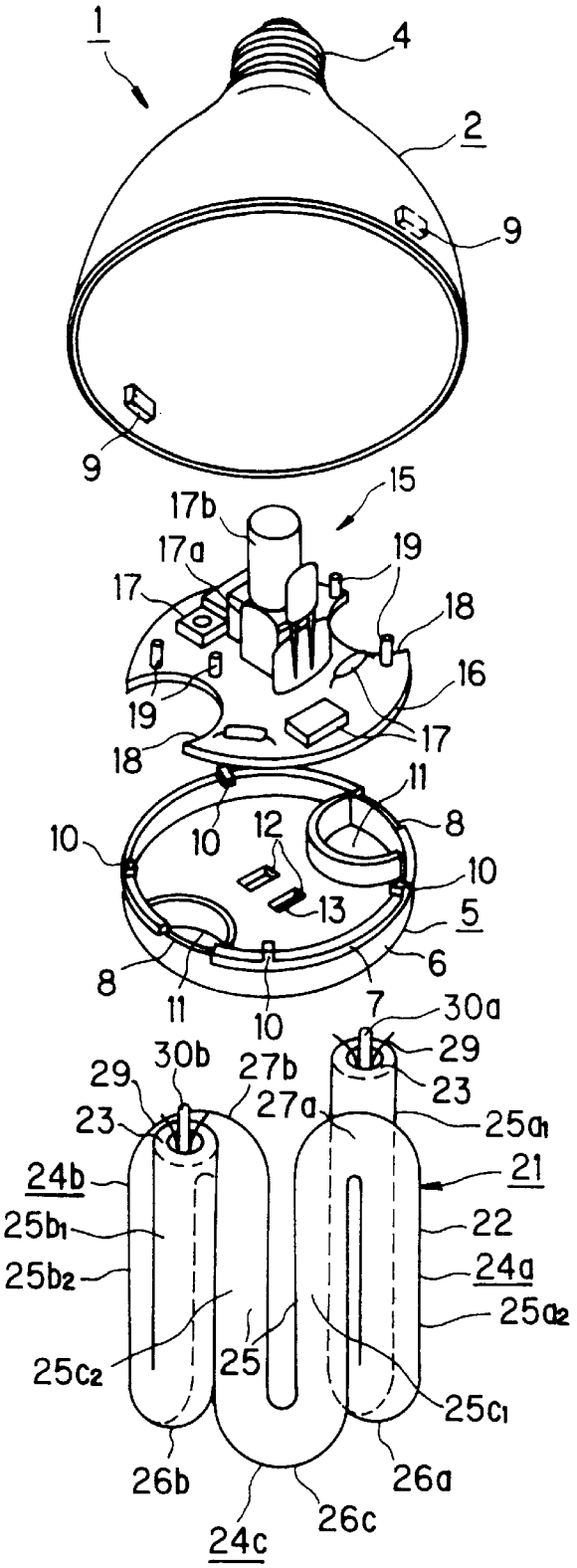
FIG. 1 an exploded perspective view of a fluorescent lamp unit of a first embodiment according to the present invention.

DESCRIPTION OF THE PREFERRED EMBODIMENTS (First Embodiment)

The first embodiment of the present invention will be described with reference to FIGS. 1 to 10.

In the drawings of FIGS. 1 to 5, there are shown an electric bulb type fluorescent lamp unit 1 and a cover 2 forming part of a substantially conical housing. The housing is composed of the cover 2 and a globe 51 that will be described later, that is, separate bodies. A cylindrical part 3 is formed as part of the cover 2 at one apex end of the cover 2. A cap 4 is fixed to the cylindrical part 3 using an adhesive or by caulking. The other end of the cover 2 opposite to the cap 4 is blocked by a partition 5. The cover 2 is made of a material different from the one made into the globe 51 that will be described later, for example, a PBT resin or any other synthetic resin that is heat resistive and non light-transmissible. Alternatively, the cover 2 may be made of a glass or ceramic.

A substantially cylindrical screw cap such as an Edison type model E26 is used as the cap 4 because of its compatibility with a cap to which an incandescent lamp is attached. The cap 4 is not limited to the type employed in this embodiment but may be of any type as long as a cap of the type has excellent compatibility with a cap to which an incandescent lamp is attached and is defined in the Japan Industrial Standard (JIS).

Figure 6:
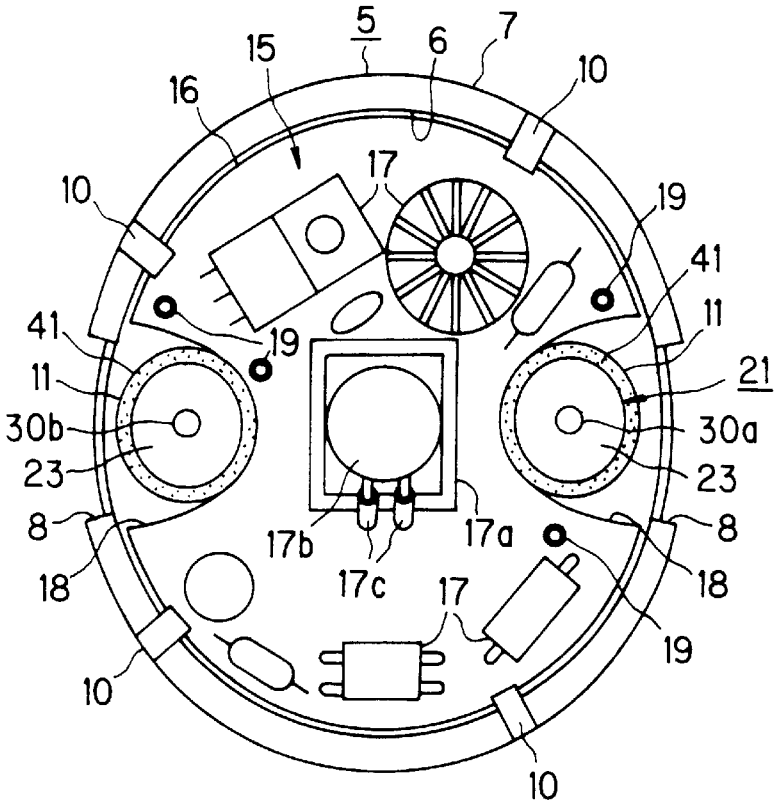
FIG. 6 is a plan view showing a state in which a partition of the fluorescent lamp unit is viewed from the side of a cap thereof.

FIG. 6 shows a state in which the partition 5 of the fluorescent lamp unit 1 is viewed from the side of the cap 4, the side corresponding to an attachment side to which the lamp unit 1 is attached. The partition 5 is made of a heat-resistive synthetic resin, for example, a PBT resin and shaped like a substantially round saucer. A flange part 7 is formed on the margin of an upper opening along a lateral wall 6 shaped like rising from the partition 5. The flange part 7 has two introduction notch parts 8 formed mutually separately along the circumference of the flange part 7. On the inner side of cover 2, stopper projections 9 that can be inserted into the introduction notch parts 8 are formed as parts of the cover 2.

The cover 2 and partition 5 are jointed and then the stopper projections 9 are inserted into the introduction notch parts 8. Thereafter, the cover 2 and partition 5 are rotated relative to each other in a circumferential direction, whereby the cover 2 and partition 5 are joined with each other.

Figure 3:
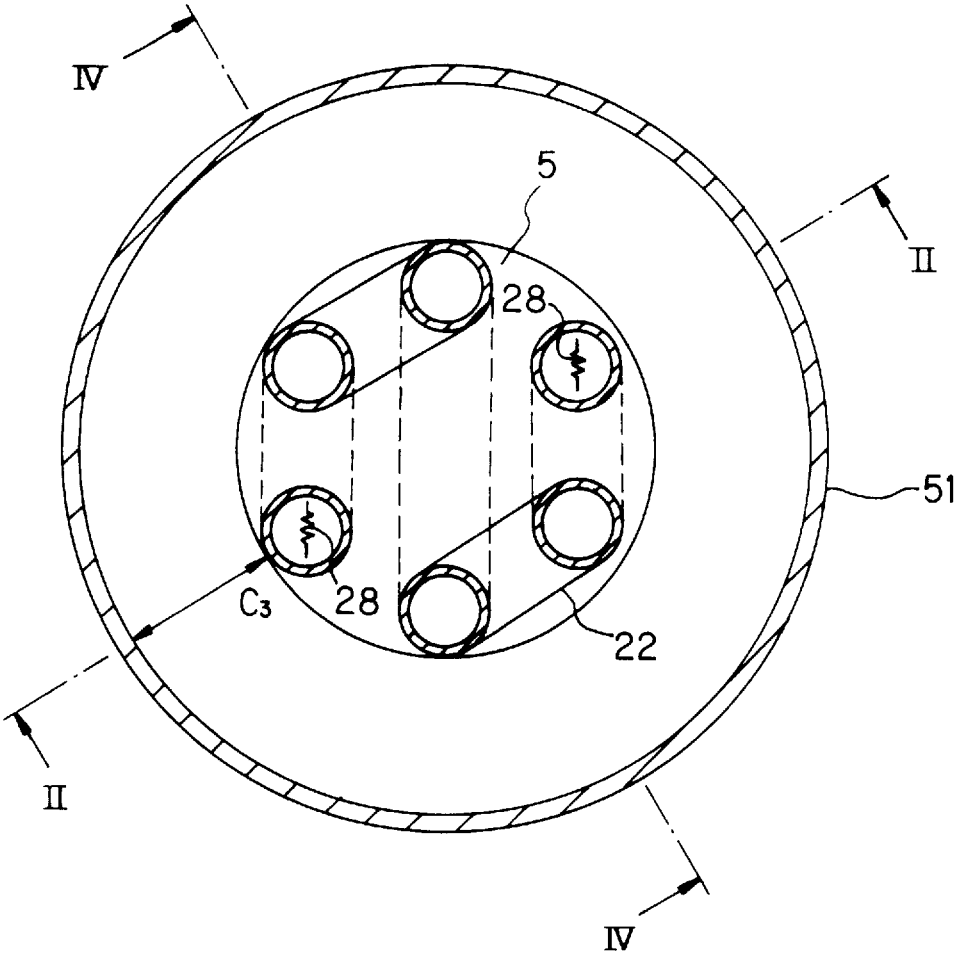
FIG. 3 is a sectional view of the fluorescent lamp unit taken in the direction of arrows substantially along line III—III of FIG. 2.
Figure 4:
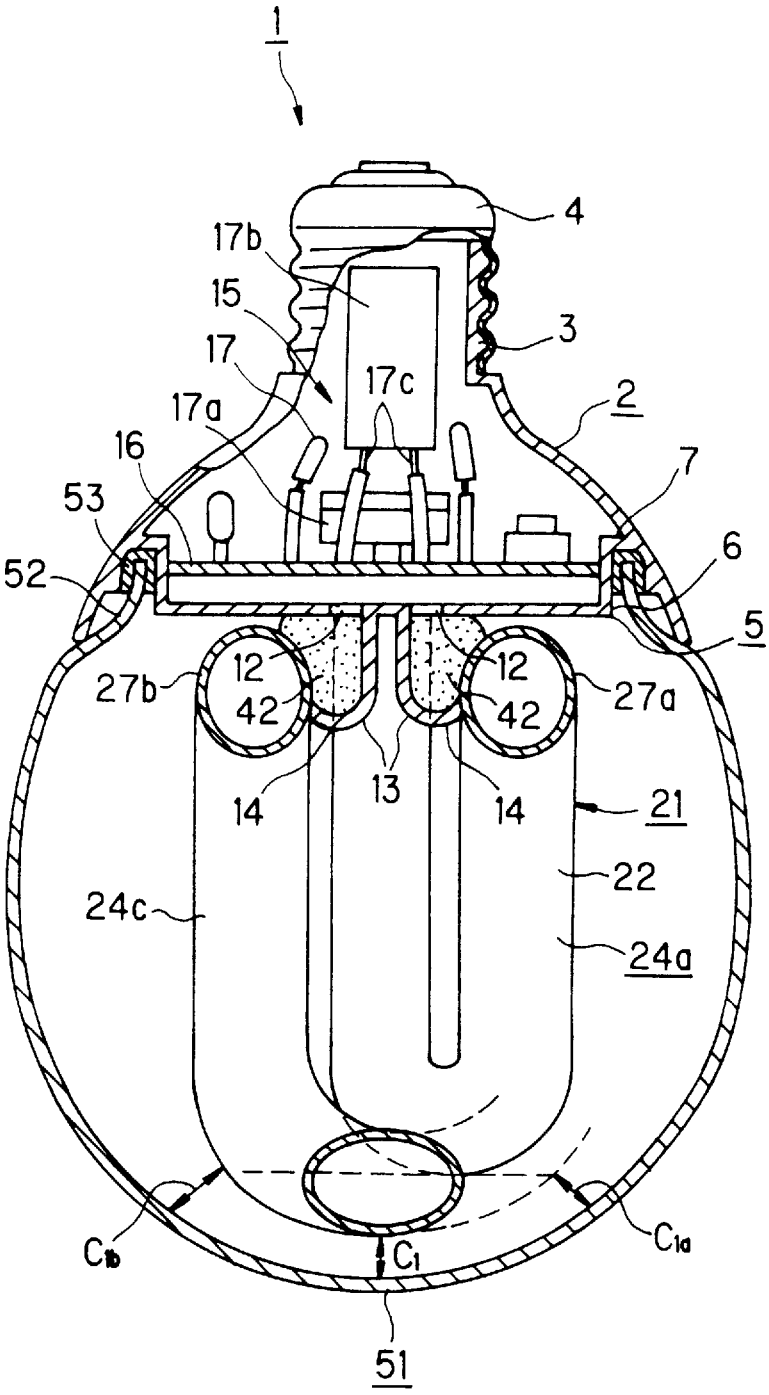
FIG. 4 is a sectional view of the fluorescent lamp unit taken in the direction of arrows substantially along line IV—IV of FIG. 3.
Figure 5:
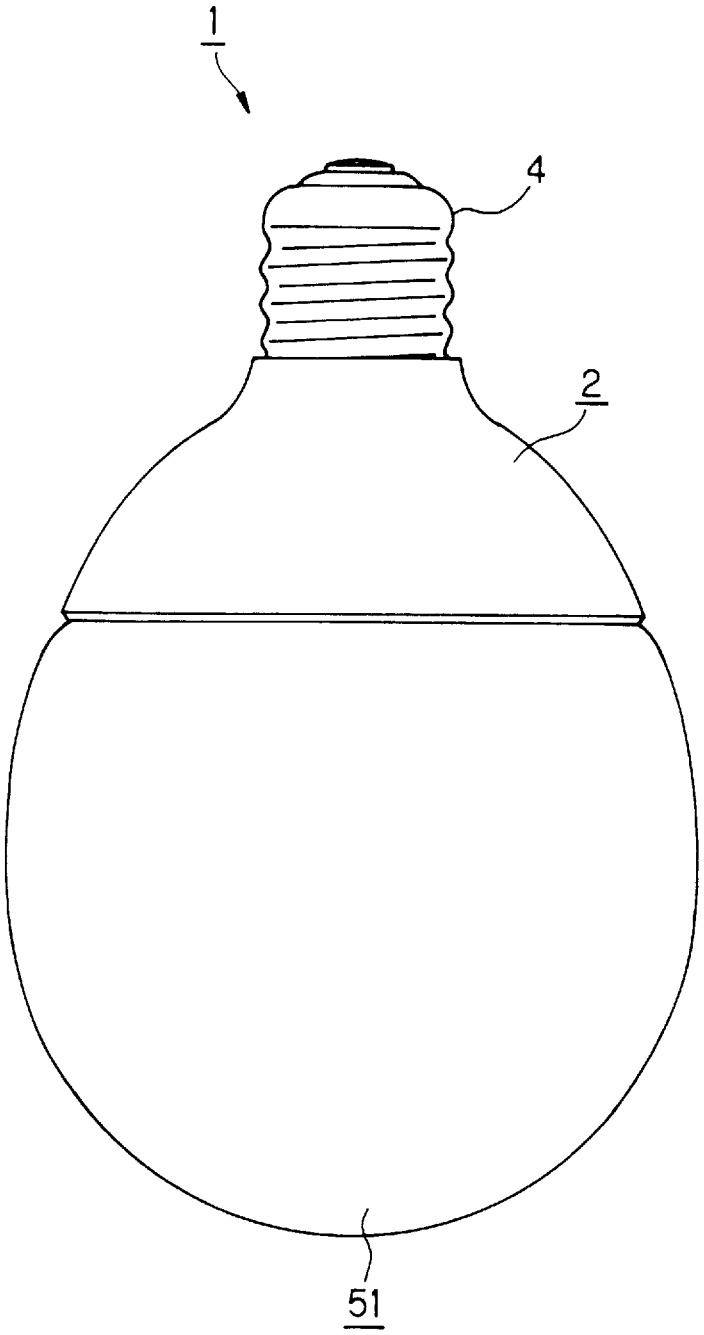
FIG. 5 is a side view of the fluorescent lamp unit.

A plurality of locking claws 10 are formed on the partition 5. The partition 5 has a pair of lamp attachment holes 11 bored at positions that are mutually 180° symmetrical. A pair of lamp support parts 13 are mounted on the center of the margins of the partition 5, projecting toward a side opposite to the attachment side. The section portion of the lamp support parts 13 along to the line IV—IV of FIG. 3 are bent substantially like a J-shape and thus formed as depression holes 14. Moreover, the attachment side is called "upper side" hereinafter and the side opposite to the attachment side (upper side) is called "lower side" hereinafter.

A lighting circuit including a ballast (an iron-core coil, inverter, or the like) and a starting circuit can be mounted on the partition 5 inside the flange part 7. In this embodiment, an inverter circuit 15 including a transistor inverter is adopted as the lighting circuit. A circuit board 16 for the inverter circuit 15 is mounted on the partition 5 by means of the locking claws 10.

The inverter circuit 15 is located in a space to be shielded by the cover 2 via the partition 5, and formed by mounting circuit elements 17, which are designed for radio-frequency lighting based on a transistor inverter, on the circuit board 16. The circuit elements 17 are, for example, a noise filter, a full-wave rectifier, a field smoothing capacitor, a transistor, a thyristor, a switching circuit such as a positive characteristic thermistor, a choke ballast, a DC cut capacitor, a resonant inductor, and a resonant capacitor.

A relatively large resonant inductor 17*a* among the circuit elements 17 is placed substantially in the center of the circuit board 16. A field smoothing capacitor 17*b* is placed to the upper side of the resonant inductor 17*a*. The field smoothing capacitor 17*b* is contained in the upper cylindrical part 3 of the cover 2 while being provided erectly on the circuit board 16, and has leads 17*c* thereof connected to the circuit board by way of the resonant inductor 17*a*. The circuit elements 17 are thus arranged compactly, making it possible to reduce the overall height of the fluorescent lamp unit 1.

Formed along the margin of the circuit board 16 are a pair of concave parts 18 that lie on a diagonal line linking mutually 180 symmetric positions. In the vicinity of each concave part 18, a pair of connection pins 19 are provided straight and electrically connected to the inverter circuit 15.

In the vicinity of one of the concave parts 18, heater elements 20 are provided straight adjacently to one exhaust pipe 30*a* of a fluorescent lamp 21 which contains an amalgam. Each of the heater elements 20 is, for example, composed of a transistor, resistor, winding, and film capacitor constituting part of the inverter circuit 15.

The fluorescent lamp 21 is located to the lower side of the partition 5.

Figure 7:
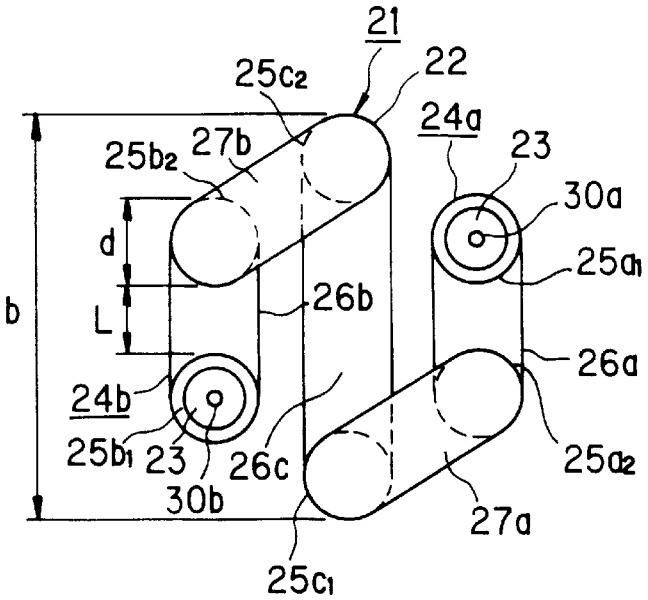
FIG. 7 is a plan view of a fluorescent lamp of the fluorescent lamp unit.
Figure 8:
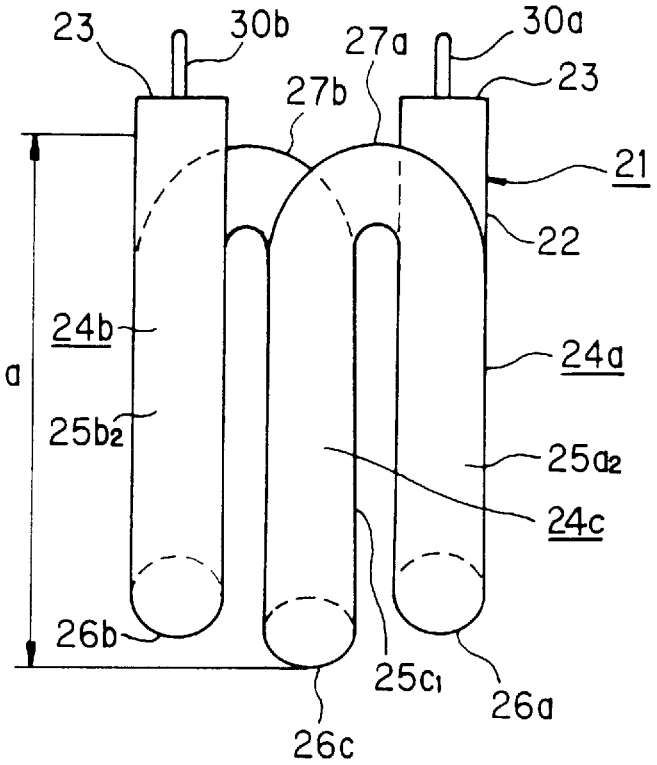
FIG. 8 is a plan view of a fluorescent lamp of the fluorescent lamp unit.

The fluorescent lamp 21, as shown in FIGS. 7 and 8, is formed with one bulb 22 made of, for example, a bent glass (lead glass or soda lime glass). Aside from the glass, the material to be made into the bulb 22 includes light-transmissible materials such as a ceramic.

An electrode 28 serving as a filament electrode is enclosed in each of sealed ends 23 of the bulb 22. Thus, a so-called stem structure is adopted. A pair of external leads 29 led out from each of the sealed ends 23 are connected to each of the electrodes 28. A phosphor coat that is not shown is formed over the inner side of the bulb 22. The bulb 22 is filled with an inactive gas such as mercury or argon. The exhaust pipes 30*a* and 30*b* are provided, projecting out of the sealed ends 23. The amalgam used to control the inactive gas vapor pressure in the bulb 22 is contained in one of the exhaust pipes or the exhaust pipe 30*a*.

The bulb 22 has a diameter of, for example 12 mm and has the sealed ends 23 as both ends thereof. Three U-shaped tubes 24*a* to 24*c* that are bent substantially like a U-shape in the same direction are formed between the sealed ends 23.

The U-shaped tubes 24*a* to 24*c* are composed of pairs of straight tube portions 25*a*1 and 25*a*2 to 25*c*1 and 25*c*2 that are provided straight in a direction parallel to the basic center axis of the lamp unit 1 (along the center axis of the cap 4 or the center axis of the globe 51 that will be described later), and bent portions 26*a* to 26*c* that are bent so as to be convexly curved toward the side opposite to the upper side thereby to form substantially U-shaped and that link the lower side ends of the pairs of straight tube portions 25*a*1 and 25*a*2 to 25*c*1 and 25*c*2 . The U-shaped tubes 24*a* to 24*c* are juxtaposed equidistantly in a direction crossed substantially at right angle to basic center axis. The straight tube portions 25*a*1 and 25*a*2 to 25*c*1 to 25*c*2 are arranged in the form of a polygon (in this embodiment, a hexagon) equidistantly along a circumference of a certain radius from the basic center axis.

Junction portions 27*a* and 27*b* are formed to link the upper side ends of the straight tube portions 25*c*1 and 25*c*2 of the central U-shaped tube 24*c* and the buck side ends of the straight tube portions 25*a*2 and 25*b*2 of the U-shaped tubes 24*a* and 24*b*, wherein the straight tube portions 25*a*2 and 25*b*2 are located at both sides of the central U-shaped tube 24*c* and wherein the straight tube portions 25*a*2 and 25*b*2 do not have the sealed ends 23. The junction portions 27*a* and 27*b* are bent so as to be convexly curved toward the upper side. The bulb 22 therefore has one bent discharge path linking both the sealed ends 23.

The bent portion 26*c* of the central U-shaped tube 24*c* among the three U-shaped tubes 24*a* to 24*c* is made longer than the other bent portions 26*a* and 26*b* of the U-shaped tubes 24*a* and 24*b* located at the both sides of the central U-shaped tube 24*c* so that the bent portion 26*c* projects to the lower side along the basic center axis.

The fluorescent lamp 21 is covered by the globe 51 that is part of the housing and is light-transmissible and light-diffusible. The globe 51 has a light transmittance ranging from substantially 90 to 95%, is made of a light-transmissible material such as a glass whose inner side is coated with a light diffusible membrane or a milky synthetic resin, and is shaped substantially like a sphere having the upper end thereof made open. The spherical shaped globe 51 means that at least the lower side portion of the globe 51 is similar to a hemispherical shape and do not include a cylindrical shape. The whole shape of the globe 51 is not always similar to a sphererical shape.

The upper opening of the globe 51 has a straight neck portion 52 having a slightly smaller diameter. The neck portion 52 of the globe 51 is inserted between the inner side of the cover 2 and the lateral wall 6 of the partition 5, and fixed to the cover 5 and partition 5 using a thermosetting adhesive 53 such as one of a silicon type. The light diffusibility of the globe 51 may be exerted by a light-transmissible material itself or may be exerted by applying a light diffusible agent over the inner surface or outer surface of a molded transparent material, by roughly finishing the surface thereof through sand blasting or the like, or by mixing a light diffusible material such as barium sulfate or calcium carbonate in the transparent material.

By the way, the fluorescent lamp unit 1 is shaped in conformity with a general dimensions for a bulb. That is, the height of the fluorescent lamp unit 1 including the height of the cap 4 is 140 mm or smaller, and the maximum diameter thereof is 100 mm or smaller. In particular, in this embodiment, the height thereof is substantially 139 mm and the maximum diameter thereof is substantially 95 mm. Therefore, the fluorescent lamp unit 1 can be fitted to a large number of types of lighting apparatuses which are designed for an incandescent lump. Eventually, the application range of the fluorescent lamp unit can be expanded.

Figure 2:
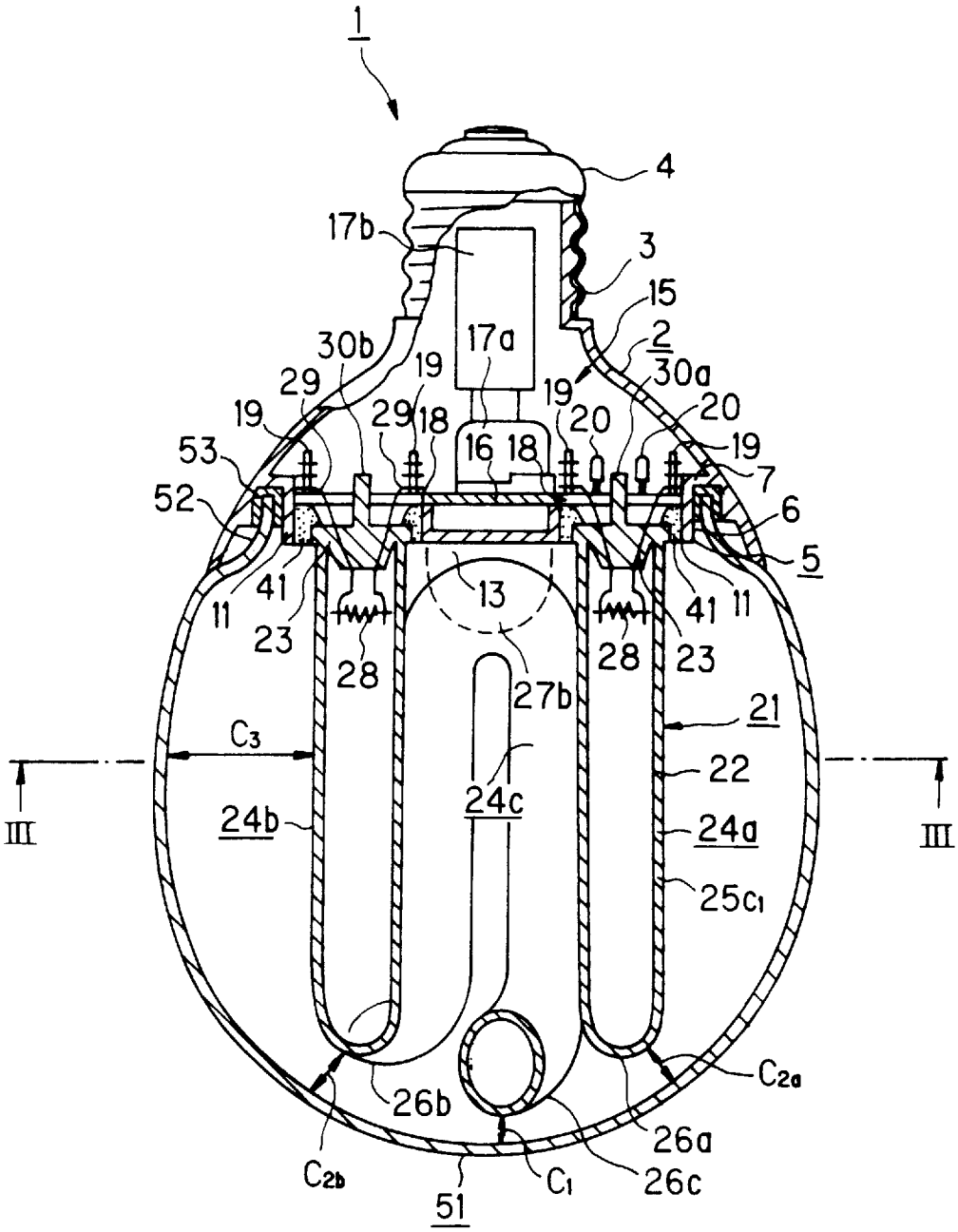
FIG. 2 is a sectional view of the fluorescent lamp unit taken in the direction of arrows substantially along line II—II of FIG. 3.

In this constitution, as shown in FIG. 2, the U-shaped tubes 24*a* to 24*c* are formed and arranged so that a minimum gap c1 between the inner surface of the globe 51 (in the constitution in which the globe 51 is excluded, a virtual sphere covering the three U-shaped tubes 25*a* to 25*c*) and the outer surface of the lower side end (apex) of the projection central U-shaped tube 24*c* which is opposite to the inner surface of the globe, and minimum gaps c2*a* and c2*b* between the inner surface of the globe 51 and the outer surfaces of the lower side ends (apices) of the U-shaped tubes 24*a* and 24*b* lying on the both sides of the central U-shaped tube 24*c* and adjoining the inner surface of the globe will have substantially the same length. That is, the minimum gap c1, c2*a* and c2*b* are substantially equal each other.

Moreover, the U-shaped tubes 24*a* to 24*c* are formed and arranged so that minimum gaps c1*a* and c1*b* between the positions on the outer surface of the bent portion 26*c* of the central U-shaped tube 24*c*, which intersect a plane that contains the outer surfaces of the apices of the U-shaped tubes 24*a* and 24*b* and that is crossed at substantially right angles to the basic center axis and the inner surface of the globe will have substantially the same length as the minimum gap c1. Namely, the minimum gap c1, c1*a* and c1*b* are substantially equal each other.

The minimum gap is defined as a gap having the smallest length of all the lengths of gaps formed between each of the outer surfaces of the apex of the central U-shaped tubes 24*a* to 24*c* or the outer surfaces of the other corner portions thereof and the inner surface of the globe.

The gaps c1, c1*a*, c1*b*, c2*a*, and c2*b* between the outer surface of the bulb 22 and the inner surface of the globe 51 should have the same dimension within 3 mm. Furthermore, the U-shaped tubes 24*a* to 24*c* are formed and arranged so that a gap (maximum gap) c3 having the largest length of all the lengths of the gaps formed between the outer surfaces of the straight tube portions 25*a*1 and 25*a*2 to 25*c*1 and 25*c*2 of the U-shaped tubes 24*a* to 24*c* of the bulb 22 adjoining the inner surface of the globe and the inner surface of the globe will be substantially one to four times as large as the length of the gaps c1, c2*a*, and c2*b* between the outer surfaces of the apices of the U-shaped tubes 24*a* to 24*c* and the inner surfaces of the globe. Preferably, the gap c3 ranges from 3 to 21 mm.

For example, in the fluorescent lamp unit of this embodiment, the gaps c1, c2*a*, and c2*b* between the outer side of the bulb 22 and the inner surface of the globe 51 range from 2 to 8 mm (preferably, from 3 to 7 mm, and in this embodiment, approximately 5 mm), and the gap c3 ranges from 15 to 21 mm.

In addition, as mentioned above, the fluorescent lamp 21 has the straight tube portions 25*a*1 and 25*a*2 to 25*c*1 and 25*c*2 of the U-shaped tubes 24*a* to 24*c* arranged on a circumference of a certain radius from the basic center axis. As shown in FIG. 7, the bulb 22 (U-shaped tubes 24*a* to 24*c*) is bent so that: assuming that the diameter of the bulb 22 is "d" and a spacing between each pair of adjoining straight tube portions 25 (between the straight tube portions 25*a*1 and 25*a*2, straight tube portions 25*b*1 and 25*b*2, and straight tube portions 25*c*1 and 25*c*2) is "L", the relationship between the diameter "d" and spacing "L" will meet the following condition:

$$0.5 \leqq d/L \leqq 1.5 \quad (1)$$

In this embodiment, "d" is approximately 12 mm and "L" is approximately 8 mm.

Next, an effective glowing section of the bent bulb 22 will be defined. The effective glowing section thereof means that the portion of the bulb 22 in which the phosphor coat is formed. However, in the case where the portion thereof in which the phosphor coat is formed do not emit light and emits light which does not transmit out of the globe by shielding, the portion of the bulb 22 is not included in the effective glowing section. That is to say, the effective glowing portion is, as shown in FIG. 8, defined as an area whose maximum length is a length in the direction of the basic center axis of the bent bulb 22 that can effectively glow and whose width is substantially equivalent to the diameter of a circumference of a circumscribed circle circumscribed by the bent bulb 22 with the basic center axis as a center. In this embodiment, the maximum length of the area is the maximum one of the lengths along to the directions of the axial centers of the U-shaped tubes 24*a* to 24*c*, which can effectively glow. In other words, the length from the ends of the effectively glowing regions of the straight tube portions 25*c*1 and c2 of the U-shaped tube 24*c*, which do not have sections for connecting the leads 29, on the side of the sealed ends to the forward apex of the bent portion 26*c* is regarded as the maximum length "a". As shown in FIG. 7, in this embodiment, a width substantially equivalent to the diameter of the circumscribed circle that has the basic center axis as a center and that is circumscribed by the straight tube portions 25*a*1 and 25*a*2 to 25*c*1 and 25*c*2, that is, the maximum one of the distances between the straight tube portions 25*a*1 and 25*a*2 to 25*c*1 and 25*c*2 which are arranged on the circumference in the form of a polygon is regarded as a maximum width "b".

In this embodiment, the bulb 22 (U-shaped tubes 24*a* to 24*c*) is bent so that the relationship between the maximum length "a" and maximum width or diameter "b" will meet the following condition:

$$0.7 < b/a < 1.4 \quad (2)$$

In this embodiment, "a" is approximately 600 mm and "b" is approximately 550 mm. The input lamp power of the fluorescent lamp 21 ranges from 20 to 23 W. The discharge path length that is a length linking the sealed ends 23 of the bulb 22 (meaning a length by which discharge progresses tortuously between electrodes) ranges from 360 to 485 mm (in this embodiment, 385 mm).

Incidentally, if the d/L value exceeds 1.5 (d/L>1.5), the spacing "L" between adjoining straight tube portions 25 is too small relative to the diameter "d" of the bulb 22. This results in a large light loss. By contrast, if the d/L value falls below 0.5 (d/L<0.5), the spacing "L" between adjoining straight tube portions 25 is too large relative to the diameter "d" of the bulb 22. Consequently, the maximum diameter of the fluorescent lamp unit 1 becomes unnecessarily large or light distribution becomes inhomogeneous. If the b/a value is equal to or larger than 1.4 (b/a≧1.4), the maximum length (height) "a" becomes too small relative to the maximum diameter "b" of the effective glowing section. As a result of that, the luminance at the apex of the substantially spherical globe 51 becomes lower than that on the lateral side thereof. Thus, the luminance on the globe 51 becomes inhomogeneous. By contrast, if the b/a value is equal to or smaller than 0.7 (b/a≦0.7), the height "a" becomes too large relative to the maximum diameter "b" of the effective glowing section. The luminance on the lateral side of the substantially spherical globe 51 becomes lower than that at the apex thereof. Thus, the luminance on the globe 51 becomes inhomogeneous.

Figure 9A:
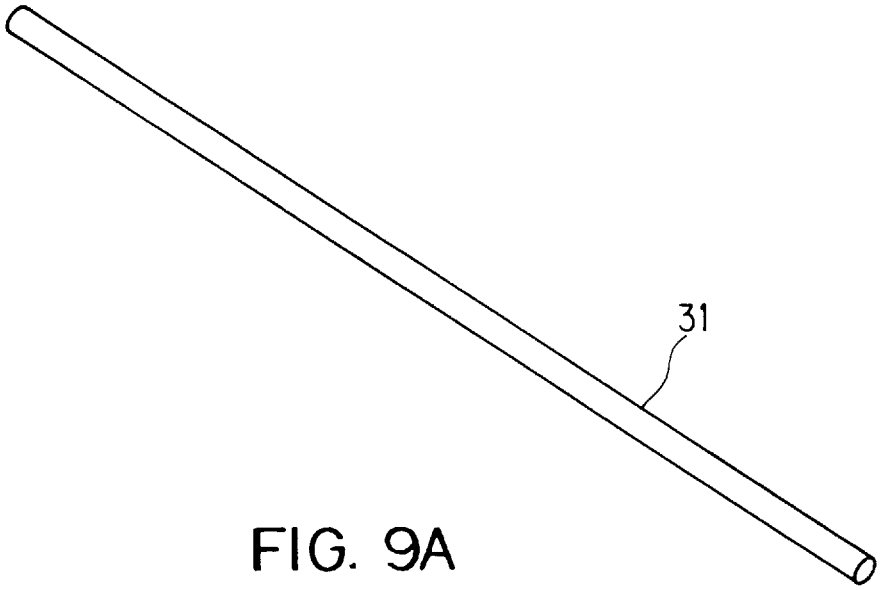
FIGS. 9A to 9C show a procedure of bending a raw bulb so as to form a U-shaped bent bulb.
Figure 9B:
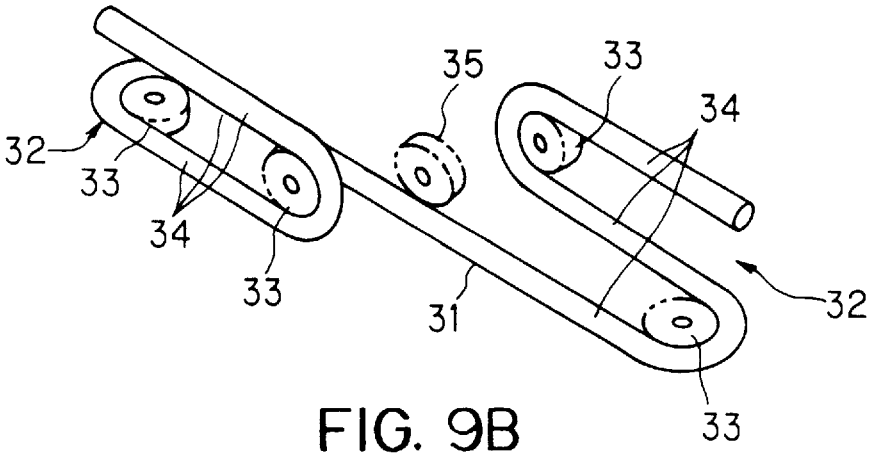
Figure 9C:
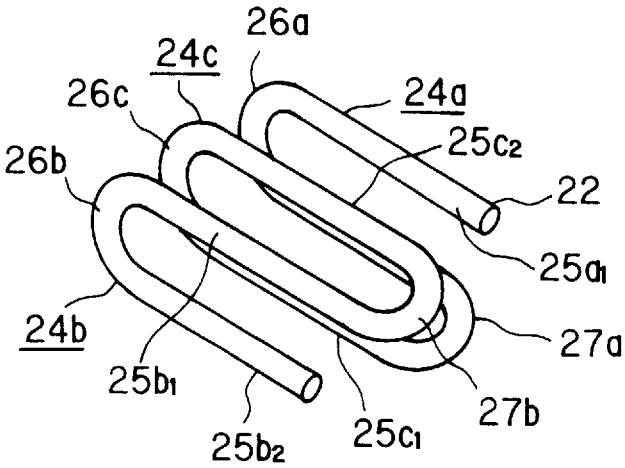

A procedure of bending the bulb 22 will be described by following FIG. 9A to FIG. 9C. FIG. 9A shows a raw bulb material 31 shaped like a straight tube. After the raw bulb material 31 is heated to be a predetermined temperature and thus softened, as shown in FIG. 9B, both ends of the raw bulb material 31 are bent substantially like a S-shape 32. The portions of both the ends bent like a letter S are bent by winding both the ends about forming drums 33. At this time, the moving trajectories of the forming drums 33 are changed mutually so that both the ends of the raw bulb material will be opposed to each other and formed symmetrically. Moreover, the portions to be processed like a S-shape are created so that three pairs of straight tube portions 34 constituting U-shaped tubes will not exist on the same plane but will be arranged three-dimensionally. Furthermore, the center of the raw bulb material 31 is bent like a U-shape along a forming drum 35. Eventually, the bent bulb 22 shown in FIG. 9C is materialized.

According to the foregoing manufacturing procedure, the bulb 22 having a complex bent structure as shown in FIGS. 7 and 8 can be formed by following two steps (five bending processes); a process of processing both ends of a raw material like a S-shape and a process of bending the center thereof.

The sealed ends 23 of the fluorescent lamp 21 are inserted into the lamp attachment holes 11 formed on the partition 5 from the lower side of the partition 5. The fluorescent lamp 21 is fixed to the partition 5 by a thermosetting adhesive 41 such as one of a silicon type with which the gaps between the sealed ends 23 and lamp attachment holes 11 are filled. The inner sides of the bent portions 27 of the bulb 22 are opposed to the lamp support chips 13 of the partition 5. A thermosetting adhesive 42 similar to the thermosetting adhesive 41 is poured through through holes 12, whereby the inner sides of the bent portions 27 are fixed to the lower side surface of the partition 5. The thermosetting adhesive 42 does not flow downward because of the depression parts 14 of the lamp attachment chips 13 into which the adhesive is poured, but adheres to the bulb 22. The fluorescent lamp 21 is fixed to the partition 5 at a total of four positions; both the sealed ends 23 and the intermediate junction portions 27*a* and 27*b*.

After the sealed ends 23 of the bulb 22 are inserted into the lamp attachment holes 11 of the partition 5, when the sealed ends 23 of the bulb 22 project through the concave parts 18 of the circuit board 16, the external leads 29 led out from the sealed ends 23 are wound about the connection pins 19 to be provided straight near the concave parts 18 of the circuit board 16. Prior to the winding, the external leads 29 are tensed, or in other words, a tension making it possible to lift the fluorescent lamp 21 by means of the external leads 29 is predetermined. In this state, the external leads 29 are wound about the connection pins 19. At this time, since the connection pins 19 are square bar type pins, the external leads 29 can be hooked on to the connection pins 19 successfully. It can be avoided that the tension is loosened.

In this state, since the external leads 29 are wound about the connection pins 19, the fluorescent lamp 21 is hung by the external leads 29. In other words, the fluorescent lamp 21 is secured temporarily before being joined with the partition by the thermosetting adhesives 41 and 42. The temporary securing makes it easy to perform the subsequent work of applying the thermosetting adhesives 41 and 42. For drying and hardening after the application, the fluorescent lamp 21 need not be held intact. This leads to improved work efficiency.

Furthermore, in this state, at least ones of the pairs of connection pins located near the concave parts 18 are positioned on a diagonal line passing through the center. The external leads 29 are therefore pulled along the diagonal line. The fluorescent lamp 21 therefore receives a supporting force along the diagonal line, so that the force is well-balanced. Although the fluorescent lamp 21 is supported by the external leads 29 alone, it will not tilt.

The fluorescent lamp 21 thus fixed to the partition 5 and electrically connected to the lighting circuit (inverter circuit) 15 on the circuit board 16 is covered with the foregoing globe 51. The globe 51 is then fixed to the cover 2 and partition 5 as mentioned above. Consequently, the fluorescent lamp unit 1 is completed.

Figure 10:
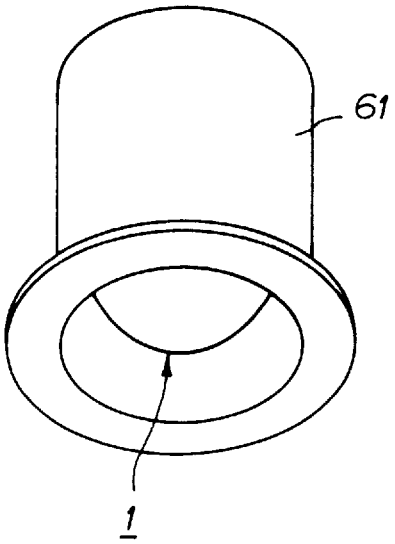
FIG. 10 is an oblique view showing an example of a lighting apparatus to which the fluorescent lamp unit is fitted.

FIG. 10 shows an example of a lighting apparatus to which the fluorescent lamp unit 1 of this constitution is fitted. The lighting apparatus is a downlight and has a cylindrical main body 61 opening downward. The fluorescent lamp unit 1 is inserted into the inside of the main body 61. An Edison type socket to which the cap 4 of the fluorescent lamp unit 1 is screwed and which is not shown is embedded in the inner upper part of the main body 61.

Next, the operation of the first embodiment will be described.

When power is supplied to the inverter circuit 15 of the fluorescent lamp unit 1 fitted to the main body 61, discharge current is fed from the inverter circuit 15 to the electrode coils 28 of the fluorescent lamp 21. Discharge is induced within the bulb 22 of the fluorescent lamp 21, whereby the fluorescent lamp 21 is lit.

When the fluorescent lamp has not been used for some time, if the temperature of the amalgam in the bulb 22 is as low as the ambient temperature, a sufficient light beam cannot be provided with power on. However, the heater elements 20 are located in the vicinity of one exhaust pipe or the exhaust pipe 30*a* containing the amalgam. The heater elements 20 dissipates heat with the start-up of the inverter circuit 15. With the heat dissipated by the heater elements 20, the exhaust pipe 30*a* and the amalgam within the exhaust pipe 30*a* are heated to facilitate a temperature rise. Even immediately after the power supply is turned on, a sufficient light beam can be provided.

According to this constitution, the three U-shaped tubes 24*a* to 24*c* of the bulb 22 are juxtaposed, and the straight tube portions 25*a*1 and 25*a*2 to 25*c*1 and 25*c*2 of the U-shaped tubes 24*a* to 24*c* are arranged on a circumference of a certain radius from the basic center axis. The relationship between the diameter "d" of the bulb 22 and the spacing "L" between straight tube portions 25 is set to $0.5 \leqq d/L < 1.5$ as provided by the expression (1). Therefore, it can be prevented an increase in light loss, which occurs in the case where the d/L value exceeds 1.5 whereby the spacing "L" between straight tube portions 25 is too small relative to the diameter "d". Besides, it can be prevented an unnecessary increase in maximum diameter of the fluorescent lamp unit 1 and an ensuing increase in inhomogeneity of light distribution, which occur when the d/L value falls below 0.5 or is less than 0.5 whereby the spacing "L" between straight tube portions 25 is too large relative to the diameter "d". In other words, the loss in light emanating from the straight tube portions 25*a*1 and 25*a*2 to 25*c*1 and 25*c*2 can be minimized optimally, while a compact design and homogeneous light distribution can be attained optimally. Moreover, since the fluorescent lamp 21 is shielded by the substantially spherical globe 51, the luminance on the surface of the globe 51 can be homogenized.

Furthermore, the three U-shaped tubes 24*a* to 24*c* of the bulb 22 are juxtaposed and the straight tube portions 25*a*1 and 25*a*2 to 25*c*1 and 25*c*2 of the U-shaped tubes 24*a* to 24*c* are arranged on a circumference of a certain radius from the basic center axis. In this state, the relationship between the maximum length "a" in the axial center direction of the bulb 22 of the effective glowing section and the maximum diameter "b" of the effective glowing section is set to $0.7 < b/a < 1.4$ as provided by the expression (2). That is to say, a decrease in the maximum length (height) "a" relative to the maximum diameter b of the effective glowing section occurring when the b/a value is equal to or larger than 1.4, an ensuing drop in luminance at the apex of the globe 51 relative to the luminance on the lateral side thereof, and an ensuing increase in inhomogeneity of luminance on the globe 51 can be prevented. Moreover, an increase in the height "a" relative to the maximum diameter "b" of the effective glowing section occurring when the b/a value is equal to or smaller than 0.7, an ensuing drop in luminance on the lateral side of the substantially spherical globe 51 relative to the luminance at the apex thereof, and an ensuing increase in inhomogeneity of luminance on the globe 51 can be prevented. In short, the homogeneity of luminance on the globe 51 can be improved, respectively.

According to this constitution, the minimum gaps c1 , c1*a*, c1*b*, c2*a*, and c2*b* between the bulb 22 of the fluorescent lamp 21 and the globe 51 are set to a substantially equal length (5 mm). In other words, the globe-side ends (apices) of the fluorescent lamp 21 adjoining the inner surface of the globe 51 are arranged equidistantly. Therefore, the shadow of the bulb 22 itself of the fluorescent lamp 21 projecting on the surface of the globe 51 can be minimized, and eventually the luminance on the surface of the substantially spherical globe 51 can be homogenized.

Figure 11A:
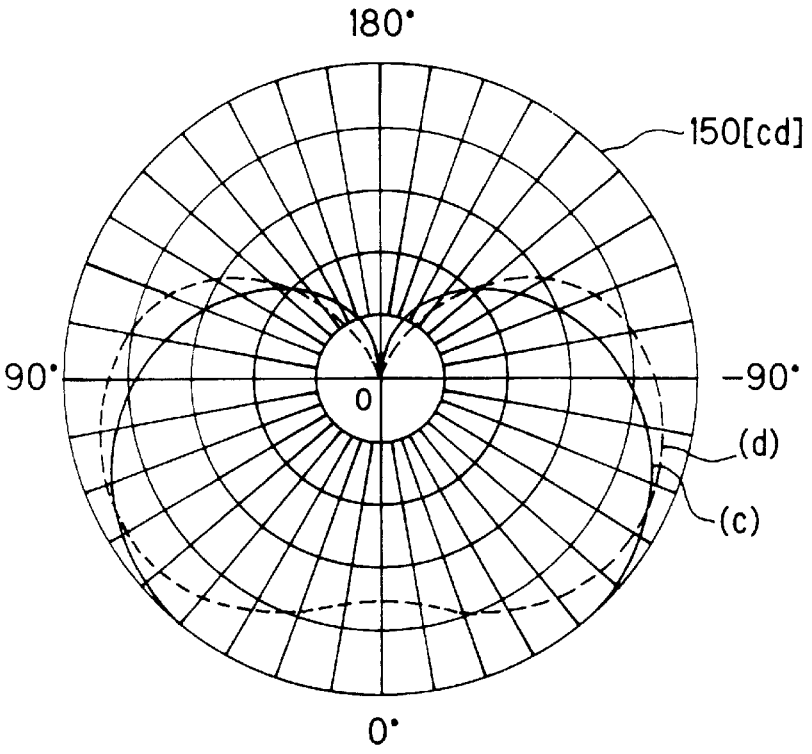
FIG. 11A indicates a light distribution characteristic of the the fluorescent lamp unit on a vertical surface along to a basic center axis.
Figure 11B:
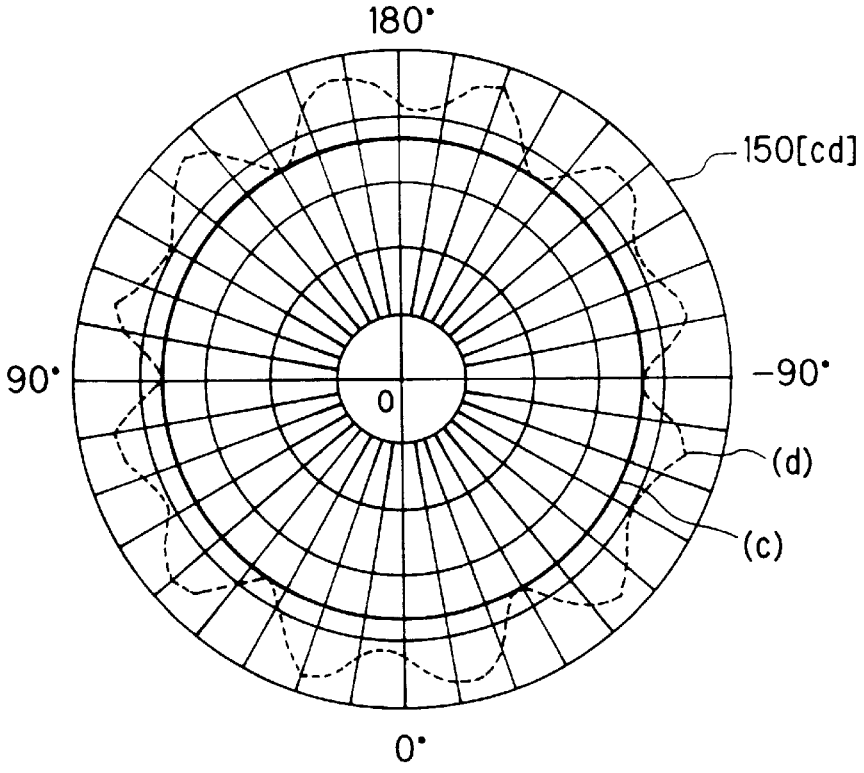
FIG. 11B indicates a light distribution characteristic of the the fluorescent lamp unit in a horizontal surface crossed at right angles to the vertical surface.

FIGS. 11A and 11B indicate the light distribution characteristics of the fluorescent lamp unit 1 of this embodiment. Herein, FIG. 11A indicates the light distribution characteristic on a vertical surface along to the basic center axis, wherein a vertical direction toward the lower side along to the basic center axis is regards as 0° so that every directions along the vertical surface are indicated by an angle with the vertical direction toward the lower side. FIG. 11B indicates the light distribution characteristic in a horizontal surface crossed at right angles to the vertical surface, wherein a predetermined horizontal direction crossed at right angles to the basic center axis is regarded as 0° so that every directions along the horizontal surface are indicated by an angle with the predetermined horizontal direction. Solid line c indicates measured values of magnitudes of light distribution in a state in which the globe 51 is attached. Dashed line d indicates measures values of magnitudes of light distribution in a state in which the globe 51 is not attached. Moreover, an axis in a radial direction indicates light intensities (cd). One scale represents 30 cd, and all scales represent 150 cd.

In the graph 11A of the light distribution characteristic on the vertical surface, when the globe is excluded, the light intensity on the lateral side is high but the light intensity in the lower side direction is low. Thus, light distribution is inhomogeneous. However, once the globe is attached, the light intensity in the lower side direction is maximized. Apparently, light distribution in the vertical surface is homogenized.

In the graph B of the light distribution characteristic on the horizontal surface, even when the globe is excluded, a difference in light intensity is slight but not very large. When the globe is attached, the difference falls within approximately 3%. The difference in light intensity in the horizontal surface is nearly nil. Quite homogeneous light distribution is attained.

Moreover, because the gaps c1, c2*a*, and c2*b* between the outer side of the bulb 22 and the inner surface of the globe 51 range from 2 to 8 mm (in this embodiment, approximately 5 mm) and the gap c3 ranges from 15 to 21 mm, it can be provided that a fluorescent lamp unit which has a small size and, in addition, it can be decreased that the lack of uniformity of the brightness of the fluorescent lamp unit.

Since the input lamp power of the fluorescent lamp 21 is set to the range from 20 to 23 W and the discharge path length is set to the range from 360 to 485 mm, a high light output substantially on a level with that of an incandescent lamp can be provided.

Furthermore, the length (height) in the center axial direction of the fluorescent lamp unit 1 including the length of the cap 4 is 139 mm (≦140 mm), and the maximum diameter thereof is 95 mm (≦100 mm). The fluorescent lamp unit 1 therefore conforms to the general dimensions for an electric lamp. The number of types of lighting apparatuses which are designed for an incandescent lamp and to which the fluorescent lamp unit can be fitted increases, expanding eventually the application range of the fluorescent lamp.

The main body 61 may be of a type to be hung on a ceiling such as a pendant type light, a type to be fixed directly to a ceiling or wall such as a ceiling light, a type to be embedded in a ceiling such as a downlight, or any other types.

(Second Embodiment)

Figure 12:
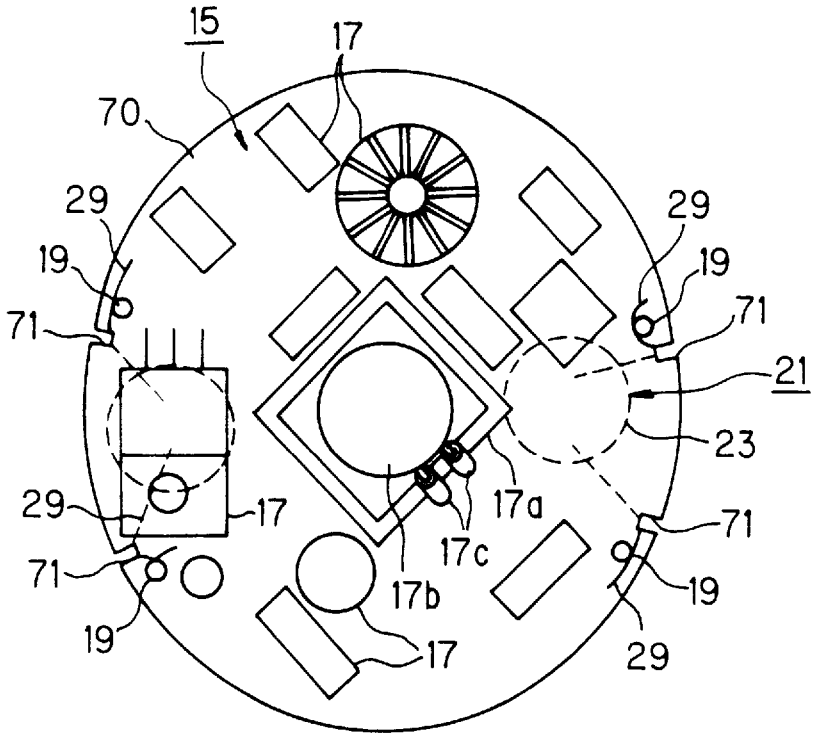
FIG. 12 is a plan view showing a circuit board that is a constituent feature of a fluorescent lamp unit of a second embodiment according to the present invention.

FIG. 12 shows a circuit board that is a constituent feature of a fluorescent lamp unit of the second embodiment. A circuit board 70 of the second embodiment does not have the concave parts 18 in the first embodiment but has a pair of opposed notch parts 71 used to lead in the external leads 29 formed along the margin of the circuit board 70. The pair of opposed notch parts 71 are located on a diagonal line. The connection pins 19 are provided straight near the notch parts 71. The other components are substantially identical to those in the first embodiment. The description of the other components will be omitted.

Using the circuit board 70 having the foregoing structure, the same effect and advantage as the first embodiment can be provided. That is to say, the circuit board 70 covers the upper sides of the lamp attachment holes 11 of the partition 5 when placed on the partition 5. When the sealed ends 23 of the fluorescent lamp 21 are inserted into the lamp attachment holes 11 of the partition 5, the external leads 29 are led into the connection pins 19 through the notch parts 71 formed on the margin of the circuit board 70, pulled and brought to a tensed state, and then wound about the connection pins 19. Thus, the fluorescent lamp 21 is hung by the external leads 29. Even in this embodiment, the support of the fluorescent lamp 21 can be assigned to the connection pins.

The circuit board 70 may be placed vertically on the top of the partition 5. The switching element 17*e* such as a transistor may be located on the lower part of the circuit board 70. When the fluorescent lamp 21 dissipates heat in abnormal fashion on the verge of ending its service life, the switching element 17*e* may be broken at the same time so that the operation of the lamp unit can be stopped reliably.

(Third Embodiment)

Figure 13:
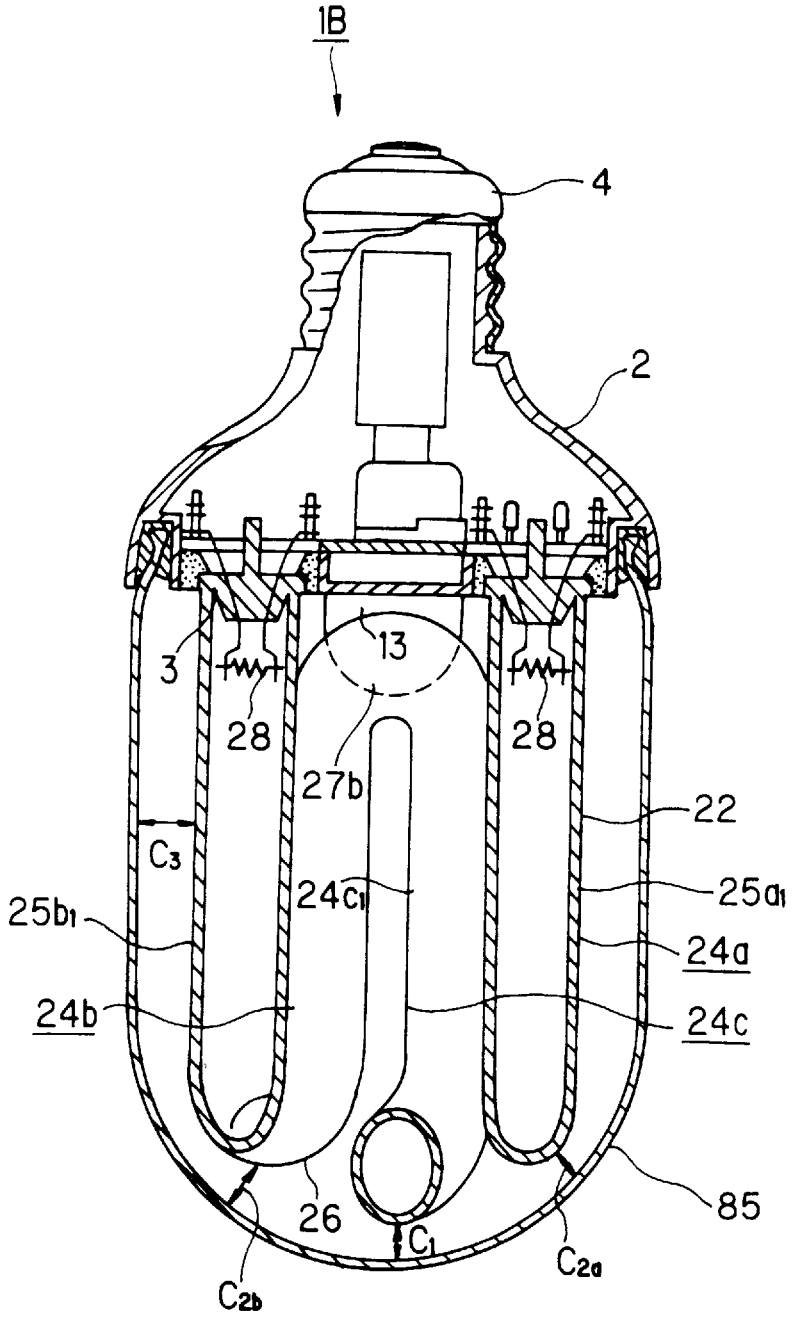
FIG. 13 is a sectional view showing a fluorescent lamp unit of a third embodiment according to the present invention.

FIG. 13 shows a fluorescent lamp unit 1B of the third embodiment. In this embodiment, the globe is not substantially spherical shape but is formed substantially in a cylindrical shape, such as called a T-shaped globe 85 in which the cover 2 includes a cylindrical part. The gaps c1, c2*a*, and c2*b* range from 2 to 8 mm (preferably, 3 to 7 mm), while the gap c3 ranges from 3 to 9 mm.

In this constitution, compared with the constitution of the first embodiment, the shape of the globe is different. An advantage substantially identical to that of the first embodiment can be provided.

In the aforesaid embodiments, the globe has light diffusibility. Alternatively, the globe may be merely transparent.

In the aforesaid embodiments, the bulb is bent a plurality of times in order to form a fluorescent lamp having three U-shaped tubes and offering one discharge path. The present invention is not limited to this structure but may apply to a structure in which the ends of three U-shaped tubes opposite the bent portions thereof are linked with a bridge pipe or blow-through pipe in order to constitute one discharge path.

In the aforesaid embodiments, the fluorescent lamp is shielded with the globe. Alternatively, the bulb (fluorescent lamp) may be bared.

Figure 14:
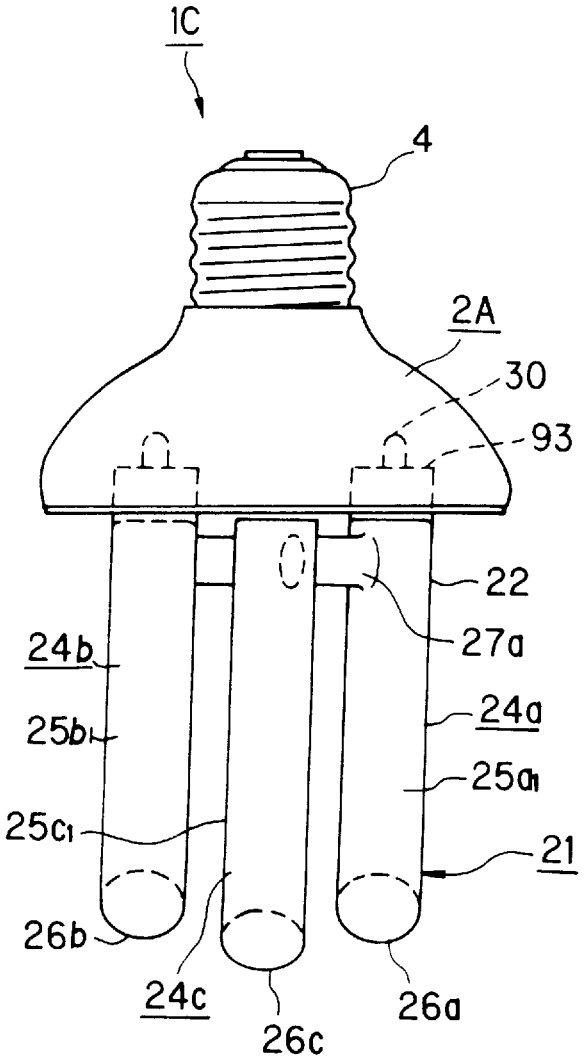
FIG. 14 is a side view showing a fluorescent lamp unit having a bulb bared structure of a variant embodiment of the present invention.

Shown as a variant embodiment of the present invention in FIG. 14 is a fluorescent lamp unit having a bulb bared structure having a fluorescent lamp in which one discharge path is formed by connecting the upper side end portions of three U-shaped tubes opposite to the bent portions thereof using a bridge pipe or blow-through pipe so that the upper side end portions can communicate with one another.

In FIG. 14, a fluorescent lamp unit 1C of this embodiment is such that a housing does not shield a major portion of a fluorescent lamp 91 but a bulb 92 is bared. Moreover, sealed ends 93 of the bulb 92 are inserted and fixed to a cover 2A serving as the housing.

The bulb 92 has, similarly to the one in the first embodiment, three U-shaped tubes 94*a* to 94*c* juxtaposed. The upper side end portions of the U-shaped tubes opposite to bent portions 26*a* to 26*c* thereof are linked with a bridge pipe 27*a* so that the upper side end portions can communicate with one another, thus forming one discharge path. The components (dimensions or the like) of the fluorescent lamp 91 except the structure of linking the U-shaped tubes using the bridge pipe 27*a* are substantially identical to those in the first embodiment (specifically, the bulb 92 is constituted so that minimum gaps (particularly, c1', c2*a*', c2*b*') between the bulb 92 and a virtual sphere shielding the bulb 92 instead of the globe have substantially the same dimensions as those in the first embodiment).

Even in this embodiment, the light distribution characteristic in a horizontal direction exhibits a slight (See the dashed line in FIG. 11B) but not very large difference in light intensity. The fluorescent lamp unit 1C that is compact and offers an excellent light distribution characteristic can be realized.

In the aforesaid embodiments, the bulb is structured in that the minimum gaps (particularly, c1, c2*a*, c2*b*) have substantially the same, the relationship between the diameter "d" and spacing "L" will meet the following condition: $0.5 \leqq d/L \leqq 1.5$, an d the relationship between the maximum length "a" and maximum width or diameter "b" will meet the following condition: $0.7<b/a<1.4$. However, the present invention is not limited to the above structure but may apply to a structure wherein the bulb is only constructed in that the minimum gaps (particularly,c1, c2*a*, c2*b*) have substantially the same. Moreover, the present invention may apply to a structure wherein the bulb is only constructed in that the relationship between the diameter "d" and spacing "L" will meet the following condition: $0.5 \leqq d/L \leqq 1.5$. Furthermore, the present invention may apply to a structure wherein the bulb is only constructed in that the relationship between the maximum length "a" and maximum width or diameter "b" will meet the following condition: $0.7<b/a<1.4$.

Especially, in the structure of the variant embodiment, it may be preferable that the bent is at least constructed in that the relationship between the diameter "d" and spacing "L" will meet the following condition: $0.5 \leqq d/L \leqq 1.5$ or the relationship between the maximum length "a" and maximum width or diameter "b" will meet the following condition: $0.7<b/a<1.4$.

In the aforesaid embodiments, the resonant capacitor, resonant ballast, and electrode coils 28 may be connected in series. The resonant ballast may be connected in parallel with the resonant capacitor and electrode coils. For example, when these circuit elements are connected in series, if the electrode coils 28 are broken, resonance ceases. Since current is supplied to the electrode coils 28 for heating even during lighting, a power loss is large. When the resonant ballast, resonant capacitor, and electrode coils 28 are connected in parallel, the power loss deriving from current supply for heating becomes nil. However, even if the electrode coils 28 are broken due to half-wave discharge caused by a worn emitter of one electrode on the verge of the end of a service life, resonance is retained. When the electrode coils 28 hit the bulb 22, the bulb 22 cracks. If the fluorescent lamp 21 is shielded by the cover 2 and globe 51 in sealed fashion, even if such a bulb crack occurs, dispersion of glass pieces can be prevented.

It should be understood that the foregoing relates to only preferred embodiments of the invention, and that it is intended to cover all changes and modifications of the example of the invention herein chosen for the purposes of the disclosure, which do not constitute departures from the spirit and scope of the invention.

What is claimed is:

1. A fluorescent lamp unit comprising:

a fluorescent lamp having a bulb constituting one discharge path, said bulb including three U-shaped tube portions;

a lighting circuit operatively connected to the fluorescent lamp for lighting the fluorescent lamp; and a cover part having a cap at one end thereof and having a globe at other end thereof for containing the lighting circuit and the fluorescent lamp;

wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis;

and wherein said three U-shaped tube portions are formed so that minimum gaps c1, c2*a*, and c2*b* between the inner surface of the globe and each of the outer surfaces of the globe side ends of the three U-shaped tube portions have substantially a same length.

2. A fluorescent lamp unit according to claim 1, wherein said three U-shaped tube portions are juxtaposed equidistantly in a direction crossed at substantially right angles to the basic center axis.

3. A fluorescent lamp unit according to claim 2, wherein said globe is formed in substantially a spherical shape and said bent portion of the central U-shaped tube portion among the three U-shaped tube portions is made longer than the other bent portions of the U-shaped tube portions located at the both sides of the central U-shaped tube portion so that the bent portion of the-central U-shaped tube portion projects toward the globe side along the basic center axis.

4. A fluorescent lamp unit according to claim 3, wherein said three U-shaped tube portions are formed so that minimum gaps c1*a* and c1*b* between positions on the outer surface of the globe side end of the bent portion of the central U-shaped tube portion, which intersect a plane that contains the outer surfaces of the globe side apices of the rest two U-shaped tube portions and that is crossed at substantially right angles to the basic center axis and the inner surface of the globe have substantially a same length as the minimum gap c1.

5. A fluorescent lamp unit according to claim 4, wherein said three U-shaped tube portions are arranged so that a gap c3 having a largest length of all the lengths of the gaps formed between the outer surfaces of the straight tube portions of the three U-shaped tube portions adjoining the inner surface of the globe and the inner surface thereof is substantially one to four times as large as the length of the minimum gaps c1, c2*a*, and c2*b*.

6. A fluorescent lamp unit according to claim 5, wherein said minimum gaps c1, c2*a*, and c2*b* range from 2 to 8 mm, respectively and said gap c3 ranges from 3 to 21 mm.

7. A fluorescent lamp unit comprising:

a fluorescent lamp having a bulb constituting one discharge path, said bulb including three U-shaped tube portions;

a lighting circuit operatively connected to the fluorescent lamp for lighting the fluorescent lamp; and a cover part having a cap at one end thereof and having a globe at other end thereof for containing the lighting circuit and the fluorescent lamp;

wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis;

and wherein said three U-shaped tube portions are formed so that the relationship between a diameter "b" of a circumscribed circle of the straight tube portions having the basic center axis as a center and a length "a" which is a maximum length along to the direction of the basic center axis of the bulb glowing effectively satisfy the following condition:

$$0.7<b/a<1.4$$

8. A fluorescent lamp unit according to claim 7, wherein said three U-shaped tube portions are juxtaposed equidistantly in a direction crossed at substantially right angles to the basic center axis and wherein said globe is formed substantially in a spherical shape.

9. A fluorescent lamp unit comprising:

a fluorescent lamp having a bulb constituting one discharge path, said bulb including three U-shaped tube portions;

a lighting circuit operatively connected to the fluorescent lamp for lighting the fluorescent lamp; and a cover part having a cap at one end thereof for containing the lighting circuit;

wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis;

and wherein each of said three U-shaped tube portions are formed so that the relationship between a diameter "d" of the pair of straight tube portions constituting the U-shaped tube portion and a spacing "L" between the pair of straight tube portions satisfy the following condition:

$$0.5\leqq d/L\leqq 1.5.$$

10. A fluorescent lamp unit according to claim 9, wherein said cover part has a globe mounted to other end thereof for containing the fluorescent lamp.

11. A fluorescent lamp unit according to claim 1, 7 or 10, wherein said globe is made of a light-transmissible material.

12. A fluorescent lamp unit according to claims 1, 7 or 10, wherein said bulb has junction portions linking the cap side end of one of the straight tube portions of the central U-shaped tube portion among the three U-shaped tube portions with the cap side end of straight tube portion which is adjacent to the one of the straight tube portions thereof and linking the cap side end of other of the straight tube portions thereof with the cap side end of straight tube portion which is adjacent to the other of the straight tube portions thereof.

13. A fluorescent lamp unit according to claim 12, wherein said junction portions are bent so as to be convexly curved toward the cap side.

14. A fluorescent lamp unit according to claim 12, wherein each of said junction portions is constructed of a pipe unit so that the cap side end of one of the straight tube portions of the central U-shaped tube portion communicates with the cap side end of straight tube portion which is adjacent to the one of the straight tube portions thereof by the pipe unit and the cap side end of other of the straight tube portions thereof communicates with the cap side end of straight tube portion which is adjacent to the other of the straight tube portions thereof by the pipe unit.

15. A fluorescent lamp unit according to claim 3, 8 or 10, wherein said cover part has a length along to the basic center axis, said length being 140 mm or smaller and has a maximum diameter thereof, said maximum diameter being 100 mm or smaller.

16. A fluorescent lamp unit according to claim 9, wherein said three U-shaped tube portions are bared.

17. A fluorescent lamp unit according to claim 1, 7 or 9, wherein said lighting circuit is operated so as to light the bulb according to an input lamp power, said input lamp power being set to the range from 20 to 23 W and wherein said discharge path has a length, said length being set to the range from 360 to 485 mm.

18. A fluorescent lamp unit according to claim 1, 7 or 10, wherein said globe is formed substantially in a cylindrical shape.

19. A lighting apparatus comprising a fluorescent lamp unit and an apparatus body to which the fluorescent lamp unit is mounted, the fluorescent lamp unit comprising:

a fluorescent lamp having a bulb constituting one discharge path, said bulb including three U-shaped tube portions;

a lighting circuit operatively connected to the fluorescent lamp for lighting the fluorescent lamp; and a cover part having a cap at one end thereof and having a globe at other end thereof for containing the lighting circuit and the fluorescent lamp;

wherein each of said three U-shaped tube portions has a pair of straight tube portions provided straight in a direction along to a basic center axis of the fluorescent lamp unit and has a bent portion being bent so as to be convexly curved toward the globe side opposite to the cap side thereby to form substantially U-shape and linking the glove side ends of the pair of straight tube portions, said straight tube portions being arranged equidistantly on a circumference of a certain radius from the basic center axis;

and wherein said three U-shaped tube portions are formed so that minimum gaps c1, c2*a*, and c2*b* between the inner surface of the globe and each of the outer surfaces of the globe side ends of the three U-shaped tube potions have substantially a same length.

* * * * *